US010531723B2

(12) United States Patent
Lea

(10) Patent No.: US 10,531,723 B2
(45) Date of Patent: Jan. 14, 2020

(54) PORTABLE ELECTRONIC DEVICE RETAINING SYSTEM

(71) Applicant: Wes Lea, Decatur, GA (US)

(72) Inventor: Wes Lea, Decatur, GA (US)

( * ) Notice: Subject to any disclaimer, the term of this patent is extended or adjusted under 35 U.S.C. 154(b) by 0 days.

(21) Appl. No.: 16/186,890

(22) Filed: Nov. 12, 2018

(65) Prior Publication Data

US 2019/0380479 A1 Dec. 19, 2019

Related U.S. Application Data

(60) Provisional application No. 62/685,045, filed on Jun. 14, 2018.

(51) Int. Cl.
*A45F 5/00* (2006.01)

(52) U.S. Cl.
CPC ..... *A45F 5/00* (2013.01); *A45F 2005/006* (2013.01); *A45F 2200/0525* (2013.01)

(58) Field of Classification Search
CPC ..... A45F 2005/006; A45F 2200/0525; A45F 3/02; A45F 5/00; A45F 2003/002; A45F 2200/0516; A45C 2011/003; A45C 13/02; A45C 13/002; A45C 2011/002; A45C 2013/025; Y10S 224/93
USPC ..... 224/581–583, 646, 647, 930
See application file for complete search history.

(56) References Cited

U.S. PATENT DOCUMENTS

| | | | | | |
|---|---|---|---|---|---|
| 5,475,674 | A * | 12/1995 | Yamashita | G11B 23/032 | 206/308.1 |
| 5,938,096 | A * | 8/1999 | Sauer | A47B 23/002 | 190/109 |
| 8,104,655 | B2 * | 1/2012 | Zhang | A45F 5/00 | 224/257 |
| 9,182,785 | B2 * | 11/2015 | Wyner | A45C 11/00 | |
| 2011/0155526 | A1 * | 6/2011 | Cheng | A45C 5/14 | 190/18 A |
| 2015/0282599 | A1 * | 10/2015 | Henry | A45F 5/00 | 224/242 |

* cited by examiner

*Primary Examiner* — Adam J Waggenspack
(74) *Attorney, Agent, or Firm* — Dunlap Bennett & Ludwig PLLC

(57) ABSTRACT

A portable electronic device retaining system is provided. The portable electronic device retaining system embodies a tray-holder assembly for securing the electronic device and a jacket-case adapted to operatively associate with the tray-holder assembly for easy transport and storage thereof. The tray-holder assembly provides side handles and bottom feet for stably securing the tray-holder assembly by hand and on a supporting surface. The jacket-case is adapted to encase the tray-holder assembly in a closed and locked mode for transport or storage, yet the jacket-case allows the handles and feet of the tray-holder assembly to operatively protrude therethrough.

9 Claims, 4 Drawing Sheets

PORTABLE ELECTRONIC DEVICE RETAINING SYSTEM

CROSS-REFERENCE TO RELATED APPLICATION

This application claims the benefit of priority of U.S. provisional application No. 62/685,045, filed 14 Jun. 2018, the contents of which are herein incorporated by reference.

BACKGROUND OF THE INVENTION

The present invention relates to portable electronic device cases and, more particularly, to a portable electronic device retaining system embodying a jacket-case and an operatively associable tray-holder assembly.

Current portable electronic device holders offer only basic functionality having to do with securing the electronic device in a case so as avoid damage to the encased device. There is no system combining a tray-holder and a separable jacket-case, wherein the tray-holder provides handles and feet for manipulating and providing stability for the electronic device secured thereto, while the jacket-case is dimensioned and adapted to conveniently store and carry the secured electronic device.

As can be seen, there is a need for a portable electronic device retaining system embodying a jacket-case that encases a tray-holder assembly. The electronic device is secured to the tray-holder, which provides side handles for manipulating the secured device. The tray-holder assembly also provides feet along a rear portion thereof to provide a stable base. The separate jacket-case surrounds and encases the tray-holder for storage and transport purposes, while still enabling full use of said side handles. The jacket-case may also provide a shoulder strap as a convenient method of toting the secured portable electronic device. In short, the present invention enables multiple user-friendly functions in a very simple structure.

SUMMARY OF THE INVENTION

In one aspect of the present invention, a portable electronic device retaining system includes the following: a tray-holder assembly having a tray portion; the tray portion dimensioned to accommodate a handheld electronic device; a handle along and spaced apart from a sidewall of the tray portion; and a plurality of feet extends from a rear portion of the tray portion; and a jacket-case having the following: a top cover portion; a bottom cover portion pivotably connected to the top cover portion so as to be movable relative to the top cover portion between an open mode and a close mode encasing the tray-holder assembly; each cover portion providing cover sidewalls having a plurality of handle cutouts dimensioned and disposed so that the handle protrudes from the jacket-case in the closed mode; and a plurality of clearance holes in the bottom cover portions so that the plurality of feet protrudes from the jacket-case in the closed mode.

In another aspect of the present invention, the portable electronic device retaining system including the following: a tray-holder assembly having a tray portion; the tray portion dimensioned to accommodate a handheld electronic device, wherein the tray portion is substantially coextensive with yet greater than said handheld electronic device; two handles, each handle spaced apart from opposing sidewalls of the tray portion; a central aperture disposed in the tray portion so that the rear of said handheld electronic device is accessible when secured to the tray portion; and a plurality of feet extends from a rear portion of the tray portion; and a jacket-case having the following: a top cover portion; a bottom cover portion pivotably connected to the top cover portion so as to be movable relative to the top cover portion between an open mode and a close mode encasing the tray-holder assembly; each cover portion providing cover sidewalls having a plurality of handle cutouts dimensioned and disposed so that the two handles protrude from the jacket-case in the closed mode; a plurality of clearance holes in the bottom cover portions so that the plurality of feet protrudes from the jacket-case in the closed mode; a latch mechanism on the jacket-case, the latch mechanism forming a locked engagement in the closed mode; and an adjustable strap associated with the jacket-case.

These and other features, aspects and advantages of the present invention will become better understood with reference to the following drawings, description and claims.

DETAILED DESCRIPTION OF THE INVENTION

Figure 1:
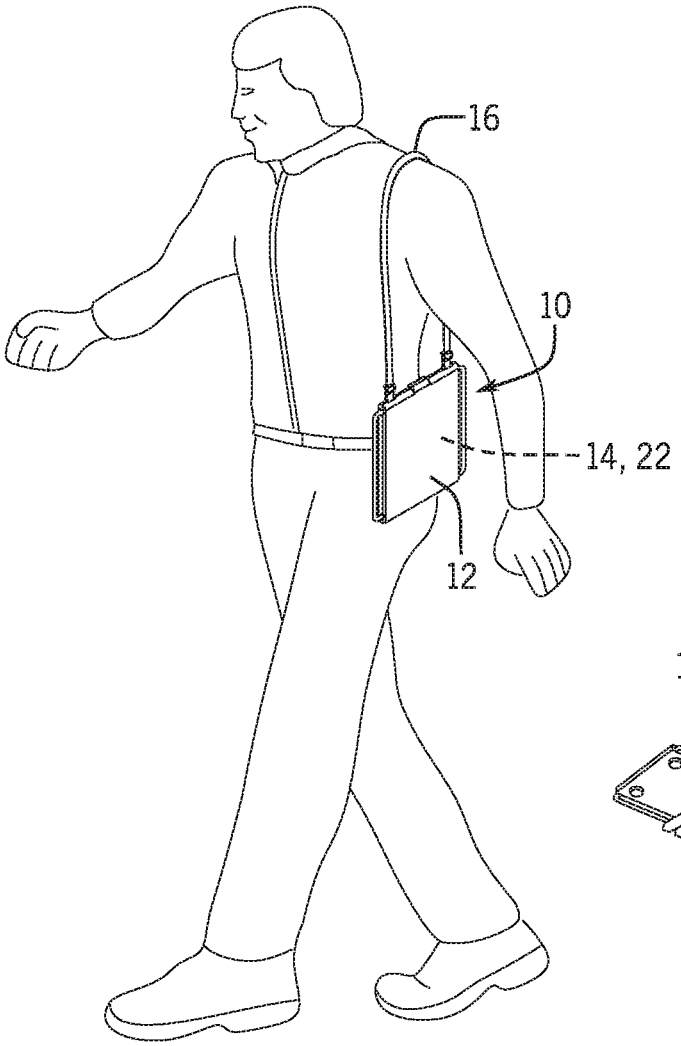
FIG. 1 is a perspective view of an exemplary embodiment of the present invention, shown in use.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a portable electronic device retaining system embodying a tray-holder assembly for securing the electronic device and a jacket-case adapted to operatively associate with the tray-holder assembly for easy transport and storage thereof. The tray-holder assembly provides side handles and bottom feet for stably securing the tray-holder assembly by hand and on a supporting surface. The jacket-case is adapted to encase the tray-holder assembly in a closed and locked mode for transport or storage, yet the jacket-case allows the handles and feet of the tray-holder assembly to operatively protrude therethrough.

Referring to FIGS. 1 through 10, the present invention may include a portable electronic device retaining system 10 embodying a tray-holder assembly 14 and a jacket-case 12. The tray-holder assembly 14 adapted for securing an electronic device 22 and the jacket-case 12 adapted to operatively associate with the tray-holder assembly 14 for storage and transport purposes. The jacket-case 12 and tray-holder assembly 14 may be made from various materials that are sturdy, resistant to shattering, and amendable to injection molding, additive manufacture or the like. Such material may include but not be limited to various plasticized materials and aluminum.

Figure 5:
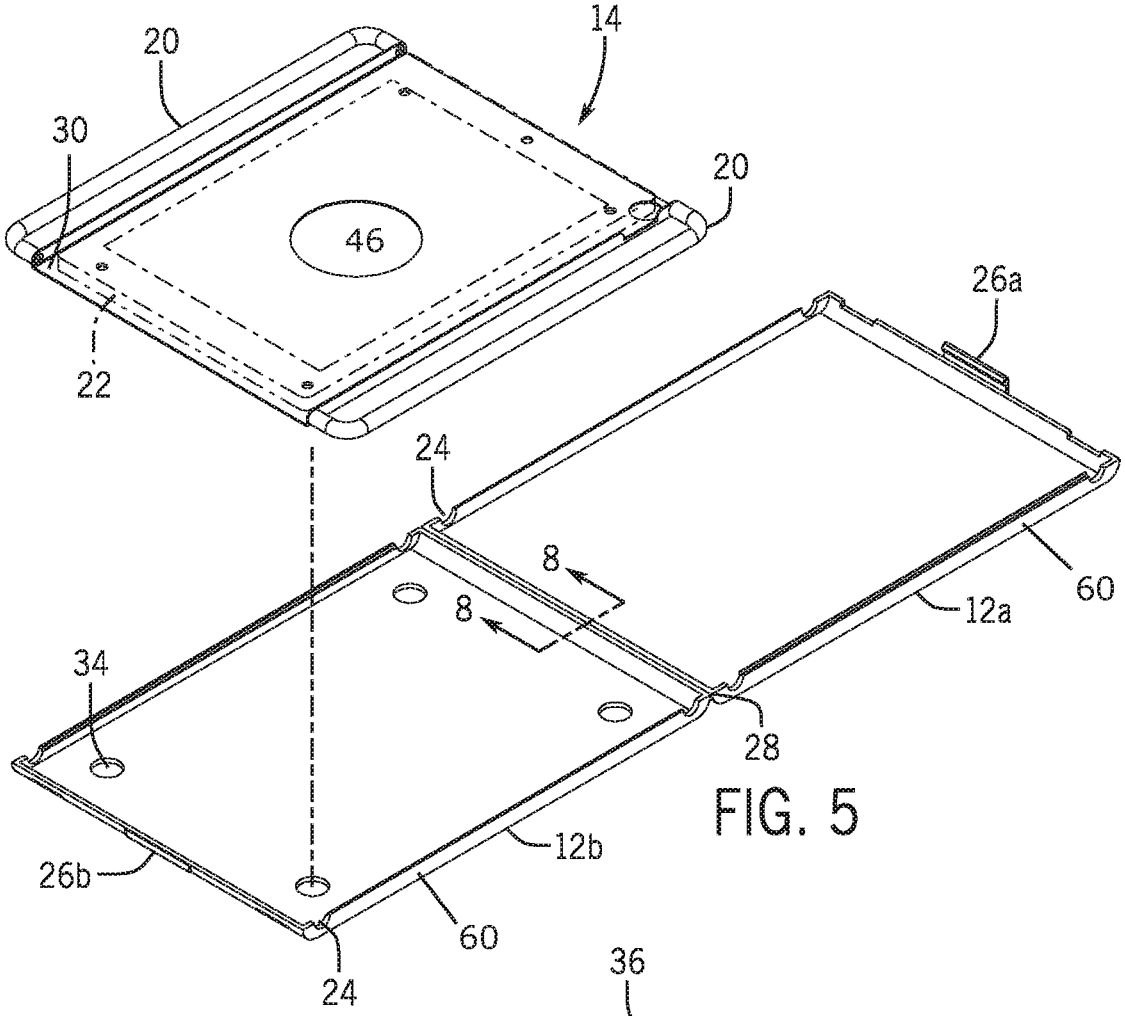
FIG. 5 is an exploded perspective view of an exemplary embodiment of the present invention, shown with the tray-holder assembly removed.
Figure 6:
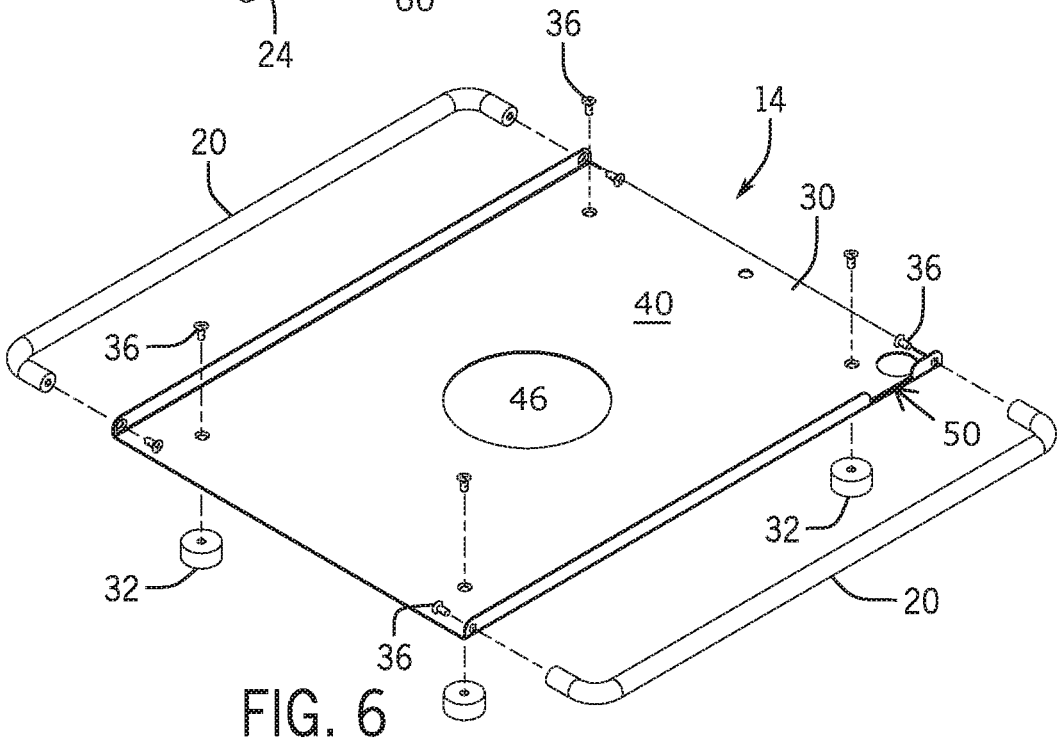
FIG. 6 is an exploded perspective view of an exemplary embodiment of the tray-holder assembly of the present invention.

The tray-holder assembly 14 may provide a tray portion 30 having a front surface 40 and a rear surface 42. The tray portion 30 may be dimensioned and adapted to accommodate a rear portion of an electronic device 22, as illustrated in FIG. 5. A central aperture 46 may be provided in the tray portion 30, communicating the front and rear surfaces 40 and 42, for rear access of the electronic device and heat thereof to escape through. The tray portion 30 may have opposing sidewalls 44. One sidewall 44 may provide a cutout 50 enabling access to electronic device controls. Each sidewall 44 may have elongated handles 20 running parallel thereto, typically connected by mounting fasteners 36. Generally, each elongated handle 20 may extend for substantially then entire length of the associated sidewall 44.

Figure 9:
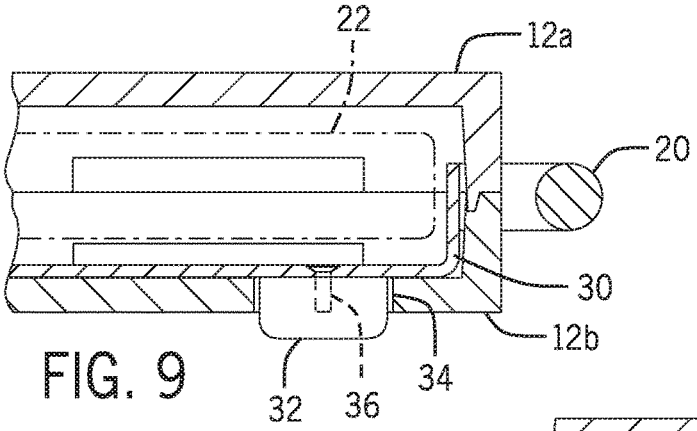
FIG. 9 is a cross-sectional view of an exemplary embodiment of the present invention, taken along line 9-9 in FIG. 3.
Figure 10:
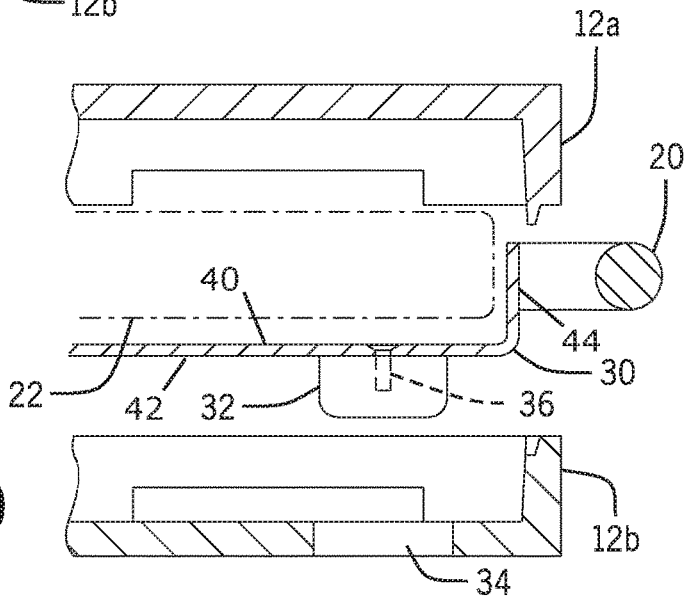
FIG. 10 is an exploded cross-sectional view of an exemplary embodiment of the present invention similar to FIG. 9.

A plurality of feet 32 may extend from the rear surface 42, outwardly away from the front surface 40, as illustrated in FIGS. 9 and 10. Mounting fasteners 36 may connect the feet 32 to the rear surface 42. Each foot 32 may be made of rubber or other non-slip material so that when they frictionally engage or grip a supporting surface the tray-holder assembly 14 and the electronic device 22 are secured therein in a manner that is stable, balanced, and prone to resist sliding along the supporting surface. In certain embodiments there may be four feet 32, each disposed just inward of a corner of the rear surface 42.

Figure 7:
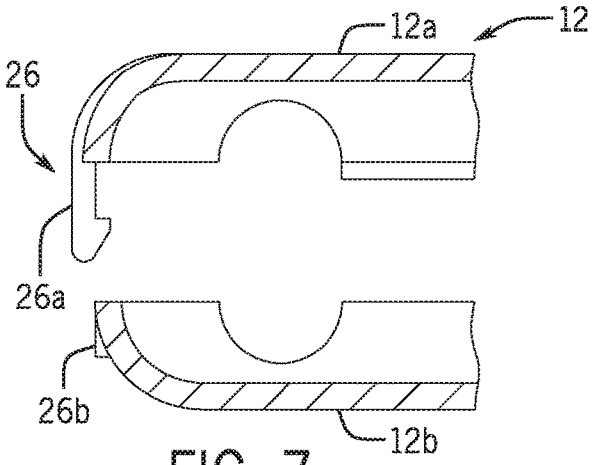
FIG. 7 is a cross-sectional view of an exemplary embodiment of the present invention, taken along line 7-7 in FIG. 3.
Figure 8:
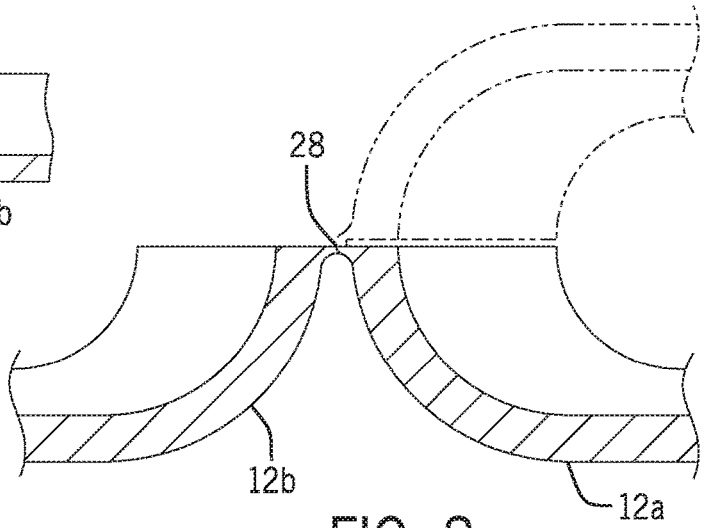
FIG. 8 is a cross-sectional view of an exemplary embodiment of the present invention, taken along line 8-8 in FIG. 5.

The jacket-case 12 may be dimensioned and adapted to encase the tray-holder assembly 14. The jacket-case 12 includes a top cover portion 12*a* and a bottom cover portion 12*b* pivotable connected together along a pivotable connection point 28, such as a living hinge, so that the top and bottom cover portions 12*a* and 12*b* are movable relative to each other between a closed mode FIG. 3 and an open mode FIG. 4. The jacket-case 12 may provide a latch mechanism 26 having a clasp portion 26*a* and a catch portion 26*b*, as illustrated in FIG. 7, that form a locked engagement in the closed mode.

Each cover portion 12*a* and 12*b* may have sidewalls 60 providing complementary handle cutouts 24 so that in the closed mode, when the tray-holder assembly 14 is encased within the jacket-case 12, the handles 20 may protrude through said handle cutouts 24 so that the handles 20 are still accessible, as illustrated in FIG. 9.

The bottom cover portion 12*b* may provide clearance holes 34, each clearance hole 34 spaced apart, dimensioned and otherwise adapted to slidably receive a respective foot 32 when the rear surface 42 is circumscribed by the bottom cover portion 12*b*, as illustrated in FIGS. 9 and 10. Thereby, the feet 32 are operable when the tray-holder assembly 14 is encased in the jacket-case 12.

The jacket-case 12 may provide a removable carrying strap 16 having adjustable buckles 18 for selectively positioning the jacket-case 12 when being transported.

Figure 2:
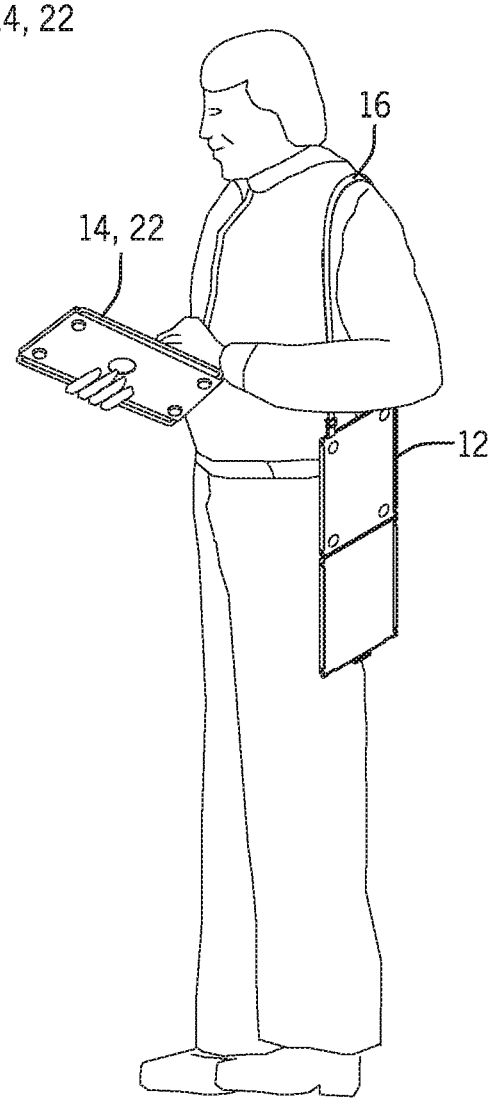
FIG. 2 is a perspective view of an exemplary embodiment of the present invention, shown in use.
Figure 3:
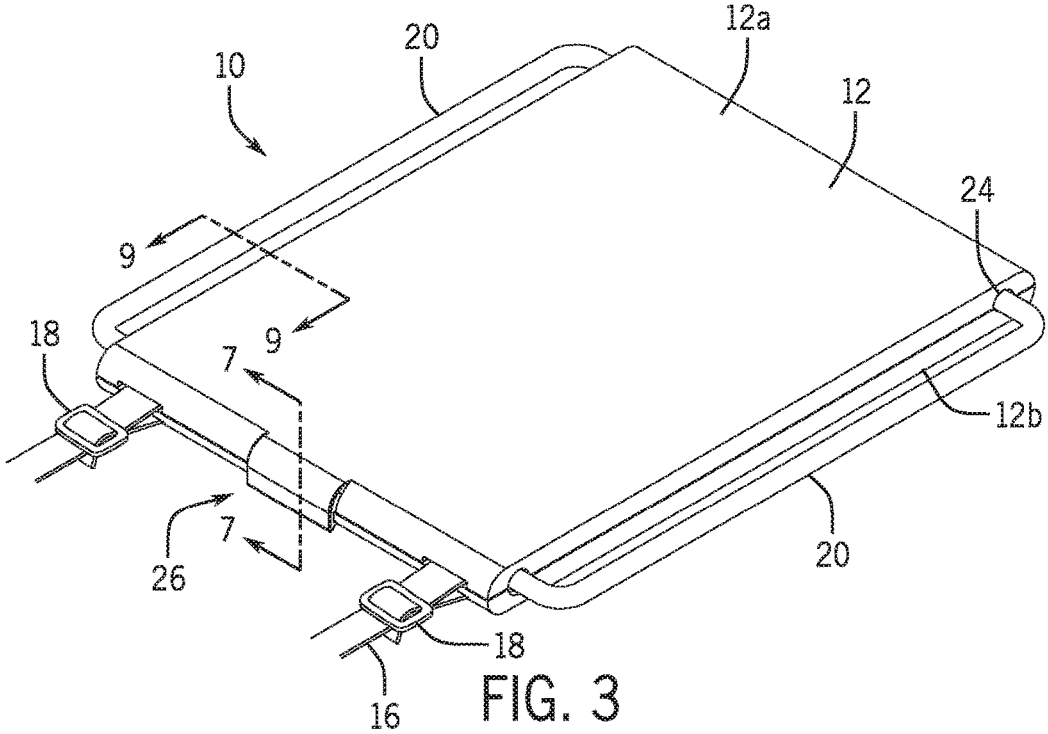
FIG. 3 is a perspective view of an exemplary embodiment of the present invention, illustrated in a closed mode.
Figure 4:
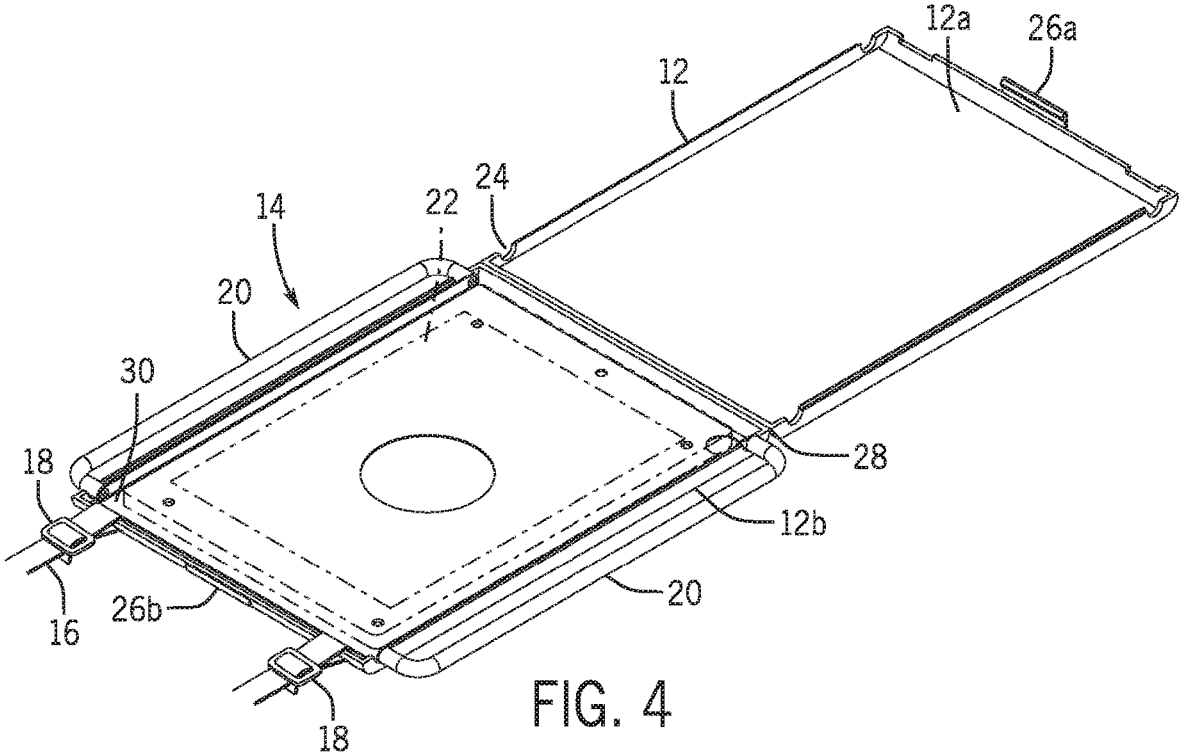
FIG. 4 is a perspective view of an exemplary embodiment of the present invention, illustrated in an open mode.

A method of using the present invention may include the following. The portable electronic device retaining system 10 disclosed above may be provided. In the open mode, a user may sit the electronic device 22 on the front surface 40 of the tray-holder assembly 14 and attach it thereto with extra strong hook and loop fasteners (not shown). The user may utilize the handles 20 when using features and functionality of the electronic device 22 while it is secured to the tray-holder assembly 14, as illustrated in FIG. 2.

When it is time to transport the electronic device 22. The the user may move the top cover portion 12*a* to the closed mode so that the latch mechanism 26 forms a locked engagement, if desired. The jacket-case 12 provides a carrying strap 16 for making such transport user-friendly, so as to strap over the shoulder, and go.

Note, the handles 20 would still be available in such the closed mode as they protrude from the jacket-case 12. The feet 32 similarly protrude through the jacket-case 12 so that the user may set the portable electronic device retaining system 10 and enable a slip-resistant base.

It should be understood, of course, that the foregoing relates to exemplary embodiments of the invention and that modifications may be made without departing from the spirit and scope of the invention as set forth in the following claims.

What is claimed is:

1. A portable electronic device retaining system, comprising:

a tray-holder assembly having a tray portion;

the tray portion dimensioned to accommodate a handheld electronic device;

a handle along and spaced apart from a sidewall of the tray portion; and a plurality of feet extends from a rear portion of the tray portion; and a jacket-case comprising:

a top cover portion;

a bottom cover portion pivotably connected to the top cover portion so as to be movable relative to the top cover portion between an open mode and a close mode encasing the tray-holder assembly;

each cover portion providing cover sidewalls having a plurality of handle cutouts dimensioned and disposed so that the handle protrudes from the jacket-case in the closed mode; and a plurality of clearance holes in the bottom cover portions so that the plurality of feet protrudes from the jacket-case in the closed mode.

2. The portable electronic device retaining system of claim 1, further comprising:

a second handle along and spaced apart from an opposing sidewall of the tray portion; and the plurality of handle cutouts dimensioned and disposed so that the second handle protrudes from the jacket-case in the closed mode.

3. The portable electronic device retaining system of claim 1, wherein the tray portion is substantially coextensive with yet greater than said handheld electronic device.

4. The portable electronic device retaining system of claim 1, further comprising a latch mechanism on the jacket-case, the latch mechanism forming a locked engagement in the closed mode.

5. The portable electronic device retaining system of claim 1, further comprising a central aperture disposed in the tray portion so that a rear of said handheld electronic device is accessible when secured to the tray portion.

6. The portable electronic device retaining system of claim 1, further comprising an adjustable carrying strap associated with the jacket-case.

7. The portable electronic device retaining system of claim 1, wherein the feet are made of a non-slip material.

8. A portable electronic device retaining system, comprising:

a tray-holder assembly having a tray portion;

the tray portion dimensioned to accommodate a handheld electronic device, wherein the tray portion is substantially coextensive with yet greater than said handheld electronic device;

two handles, each handle spaced apart from opposing sidewalls of the tray portion;

a central aperture disposed in the tray portion so that a rear of said handheld electronic device is accessible when secured to the tray portion; and a plurality of feet extends from a rear portion of the tray portion; and a jacket-case comprising:

a top cover portion;

a bottom cover portion pivotably connected to the top cover portion so as to be movable relative to the top cover portion between an open mode and a close mode encasing the tray-holder assembly;

each cover portion providing cover sidewalls having a plurality of handle cutouts dimensioned and disposed so that the two handles protrude from the jacket-case in the closed mode;

a plurality of clearance holes in the bottom cover portions so that the plurality of feet protrudes from the jacket-case in the closed mode;

a latch mechanism on the jacket-case, the latch mechanism forming a locked engagement in the closed mode; and an adjustable carrying strap associated with the jacket-case.

9. The portable electronic device retaining system of claim 8, wherein the feet are made of a non-slip material.

* * * * *